US007306547B2

(12) United States Patent
Stearns

(10) Patent No.: US 7,306,547 B2
(45) **Date of Patent: *Dec. 11, 2007**

(54) TORSO EXERCISE METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 303 days.

This patent is subject to a terminal disclaimer.

(21) Appl. No.: 10/934,817

(22) Filed: Sep. 3, 2004

(65) Prior Publication Data

US 2006/0052225 A1 Mar. 9, 2006

(51) Int. Cl.
*A63B 21/00* (2006.01)

(52) U.S. Cl. ..... 482/91

(58) Field of Classification Search ..... 482/91, 482/140, 907, 62; D21/662, 665
See application file for complete search history.

(56) References Cited

U.S. PATENT DOCUMENTS 6,814,690 B1 * 11/2004 Stearns ..... 482/52
2006/0014614 A1 * 1/2006 Szabo et al. ..... 482/140

* cited by examiner

*Primary Examiner*—Lori Amerson

(57) ABSTRACT

An abdominal exercise device includes a frame, and upper and lower force receiving members movably mounted on respective portions of the frame and constrained to move in opposite directions. A person using the device is required to stabilize the device while seated on a conventional chair. A resistance device is interconnected between the frame and at least one of the force receiving members to resist movement of the members toward one another and/or to bias the members away from one another. The lower member is configured to support a person's feet, and the upper member is configured to support a person's hands and/or to engage a person's chest. The device facilitates a combination crunch and leg lift exercise that involves both a person's upper abdominal muscles and a person's lower abdominal muscles, and additional options are available to exercise a person's oblique muscles, as well.

15 Claims, 10 Drawing Sheets

TORSO EXERCISE METHODS AND APPARATUS

FIELD OF THE INVENTION

The present invention relates to exercise equipment, and in particular, to torso exercise methods and apparatus.

BACKGROUND OF THE INVENTION

Various exercise devices have been developed to exercise various muscles of the human body, including a person's torso muscles. Many such devices primarily work only a person's upper abdominal muscles or a person's lower abdominal muscles. Other prior art devices effectively work both, and some known devices work a person's oblique muscles, as well. Generally speaking, the combination devices are either relatively complicated and expensive, or relatively ineffective. In another words, a need remains for a simple and effective torso exercise device.

SUMMARY OF THE INVENTION

The present invention provides exercise apparatus and methods suitable for exercise of a person's torso muscles. A preferred embodiment of the present invention includes a frame designed to be supported by a person seated on a conventional chair; an upper body support movably mounted on the frame and biased toward an upward position; and a lower body support movably mounted on the frame and biased toward a downward position. Many of the features and advantages of the present invention will become apparent to those skilled in the art from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a preferred embodiment exercise device constructed according to the principles of the present invention;

DETAILED DESCRIPTION OF A PREFERRED EMBODIMENT

Figure 1:
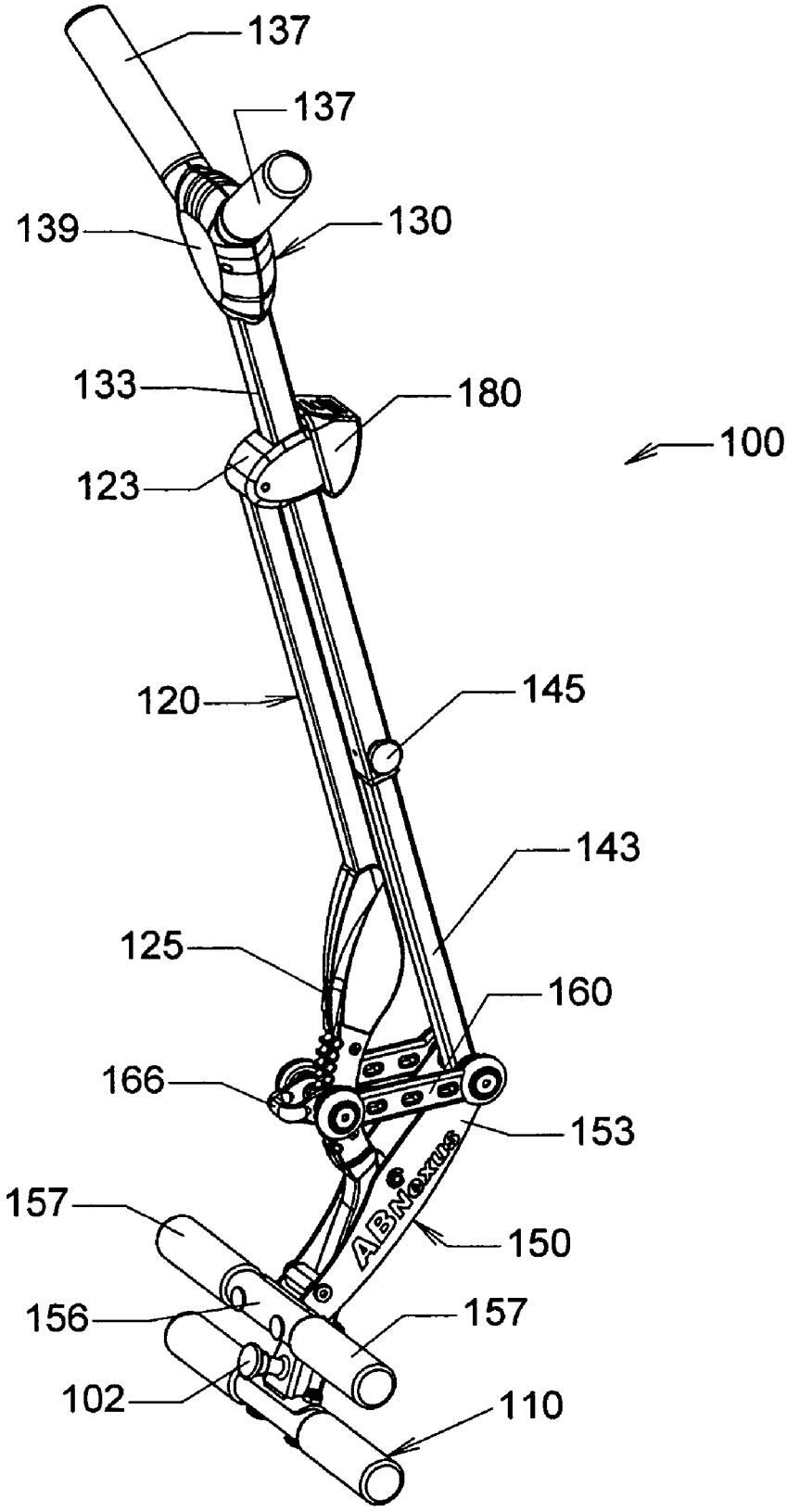

A preferred embodiment exercise device constructed according to the principles of the present invention is designated as 100 in FIGS. 1-10. The device 100 may be described generally in terms of a frame, an upper body support movably mounted on the frame, a lower body support movably mounted on the frame, and a means for biasing the upper body support toward an upper end of the frame, and/or for biasing the lower body support toward a lower end of the frame.

The components of the exercise device 100 may take various forms and/or be made in various manners. In the accompanying figures, many of the structural members are steel tubes, and there is relatively little shrouding. Among other things, it is to be understood that various shrouds may or may not be provided about the apparatus or portions thereof.

The frame may be described in terms of a base 110 configured to bear against a floor surface, and a stanchion 120 having a lower end secured to the base 110. The base 110 includes a cylindrical tube 112 and opposite end caps 114 mounted on respective ends of the tube 112. The stanchion 120 includes a square tube that supports a pivot joint 152 relatively nearer its lower end. The pivot joint 152 includes a cylindrical tube that is welded in transverse fashion onto the square tube.

Figure 9:
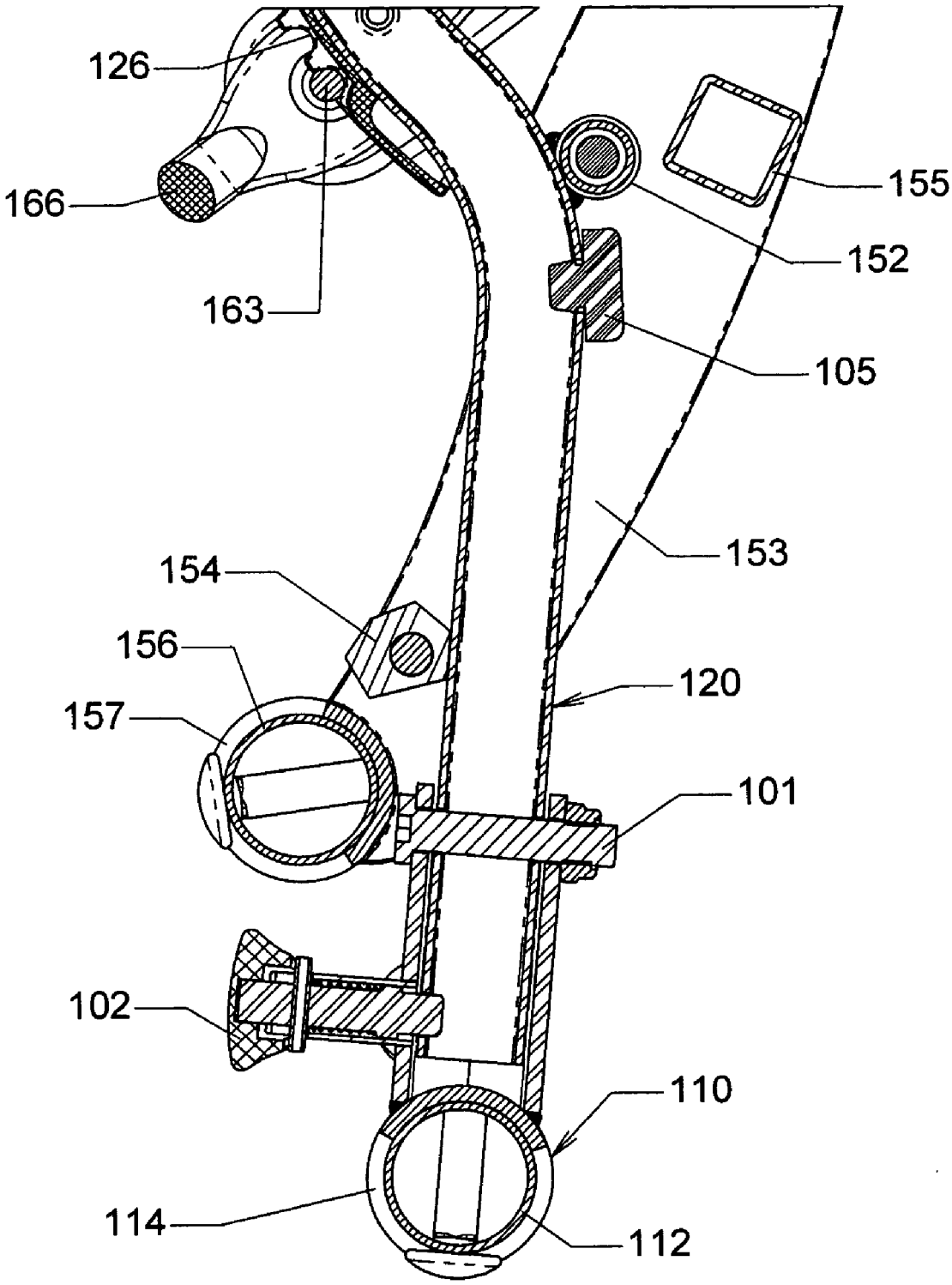
FIG. 9 is a sectioned side view of a lower portion of the exercise device of FIG. 1.

On the depicted embodiment, the stanchion 120 is selectively pivotal relative to the base 110 for reasons discussed below. As shown in FIG. 9, a bolt 101 is secured through overlapping holes in the stanchion 120 and the base 110, thereby defining a pivot axis. Also, a "pop-pin" 102 is movably mounted on the base 110 and selectively inserted through a hole in the stanchion 120 to secure the stanchion 120 in an upright, perpendicular orientation relative to the base 110. When the "pop-pin" 102 is removed from the hole in the stanchion 120, the stanchion 120 is pivotal approximately ten degrees in either direction about the bolt 101. Those skilled in the art will recognize that the subject invention may be implemented without this feature, or that this feature may be implemented in other ways, including a resilient member that biases the stanchion 120 toward the middle without locking the stanchion 120 in any particular orientation.

Figure 10:
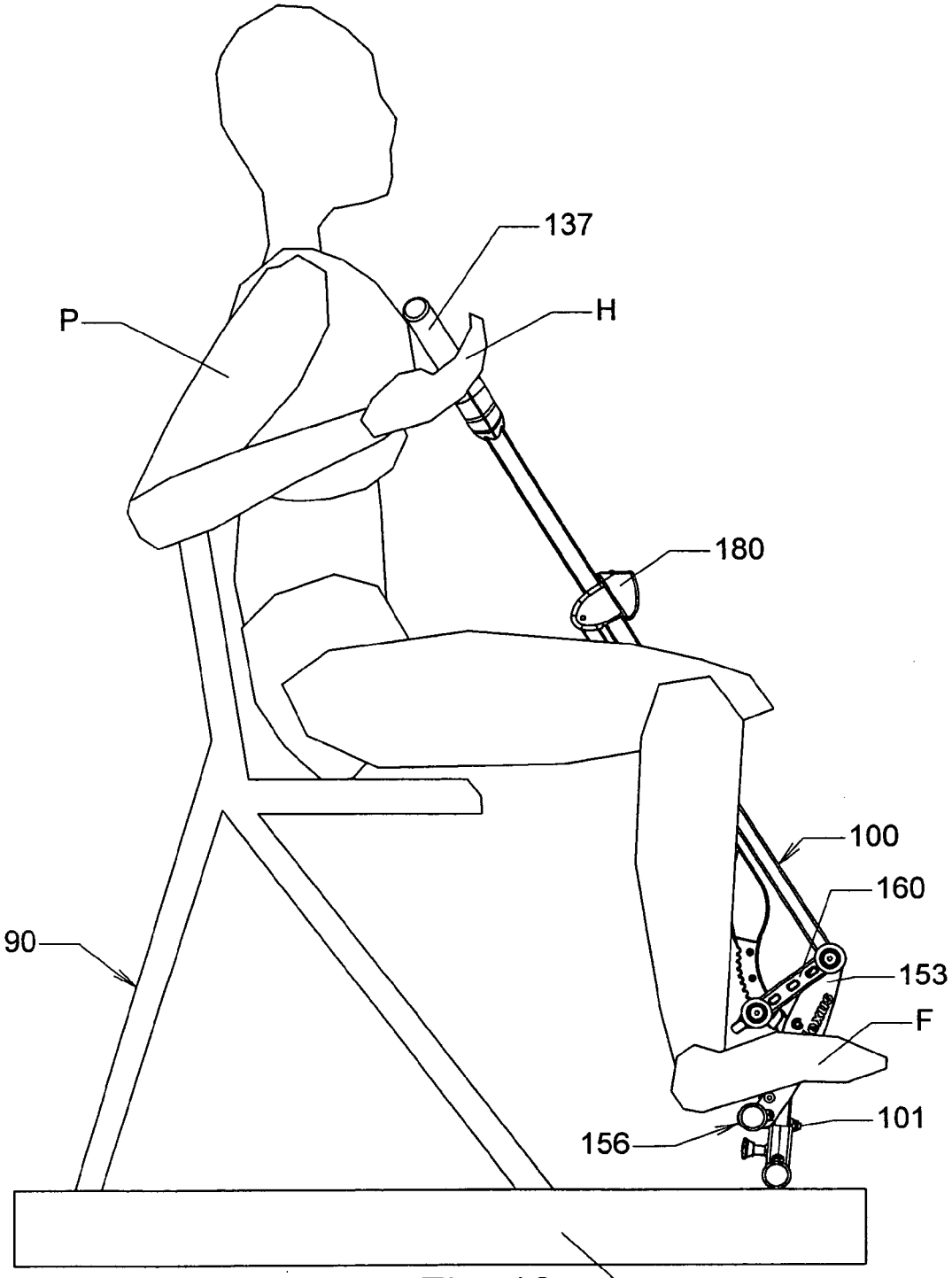
FIG. 10 is a side view of the exercise device of FIG. 1 being used by a person seated on a conventional chair.

A guide or sleeve 123 is pivotally mounted on an opposite, upper end of the stanchion 120 to accommodate insertion and sliding movement of an upper bar segment 133. The upper bar segment 133 is part of the upper body support or plunger 130, which also includes a laterally extending handlebar 135 mounted on top of the upper bar segment 133. Opposite ends of the handlebar 135 extend laterally outward and upward from respective sides of the upper bar segment 133 (for grasping as shown in FIG. 10). Left and right hand grips 137 are mounted on respective ends of the handlebar 135, and a padded cover or shroud 139 is preferably secured about the juncture between the handlebar 135 and the upper bar segment 133. This juncture may includes a resilient member interconnected in series between the handlebar 135 and the upper bar segment 133 to accommodate twisting and/or rocking of the handlebar 135 relative to the upper bar segment 133.

A lower bar segment 143 is inserted in telescopic fashion into the lower end of the upper bar segment 133, and a fastener 145 is inserted through a hole in the upper bar segment 133 and one of several holes in the lower bar segment 143. The fastener 145 is a "ball-detent" type pin that operates in a manner known in the art to remain within the associated holes. However, various other known fasteners, including spring-biased "pop-pins", may be used without departing from the scope of the present invention. This arrangement accommodates people of different sizes by facilitating adjustment of the distance defined between the handlebar 135 and the base 110 when the device 100 is at rest.

An opposite, lower end of the lower bar segment 143 is pivotally connected to the forward ends of parallel bars or plates 153, which are part of the lower body support or lever 150. In this regard, a bolt or other suitable fastener is inserted through aligned holes in the bars 153 and the lower bar segment 143. The bars 153 have opposite, rearward ends that are rigidly secured to an intermediate portion of a foot rest 156. Also, a bolt or other suitable fastener is inserted through an intermediate portion of each bar 153 and through the pivot joint 152 on the stanchion 120 to pivotally mount the lower body support 150 on the stanchion 120. The foot rest 156 is a cylindrical tube having opposite distal ends that extend in opposite directions away from the bars 153, and respective left and right caps 157 mounted on the distal ends.

The interconnections between the stanchion 120, the upper body support 130, and the lower body support 150 constrain the handlebar 135 and the foot rest 156 to move in generally opposite directions relative to the stanchion 120 (when the stanchion 120 is maintained in a stable position). For example, when a person pushes the upper body support 130 downward, the foot rest 156 is constrained to move upward. Though not shown on the embodiment 100, respective left and right toe cups, foot straps, or other "anchors" may be mounted on the distal ends of the foot rest 156 to overlie a person's feet and receive an upward pulling force exerted by a person's feet. Any resulting upward movement of the foot rest 156 will coincide with downward movement of the upper body support 130.

As shown in FIG. 9, a spacer 154 is interconnected between the bars 153, and is preferably configured and arranged to act as a stop that engages the stanchion 120 to limit downward pivoting of the foot rest 156. Also, a spacer 155 is interconnected between the bars 153, and is preferably configured and arranged to act as a stop that engages the stanchion 120 (in this case, a bumper 105 on the stanchion 120) to limit upward pivoting of the foot rest 156.

The force of gravity acting on a person's legs tends to resist movement of the handlebar 135 and the foot rest 156 toward one another, while the force of gravity acting on a person's chest, shoulders, and head tends to assist such movement. Although added resistance or assistance is not necessary to practice the subject invention, the embodiment 100 is shown with a desirable resistance system that is configured and arranged to resist movement of the handlebar 135 and the foot rest 156 toward one another, and/or to bias the handlebar 135 upward and the foot rest 156 downward.

Figure 2:
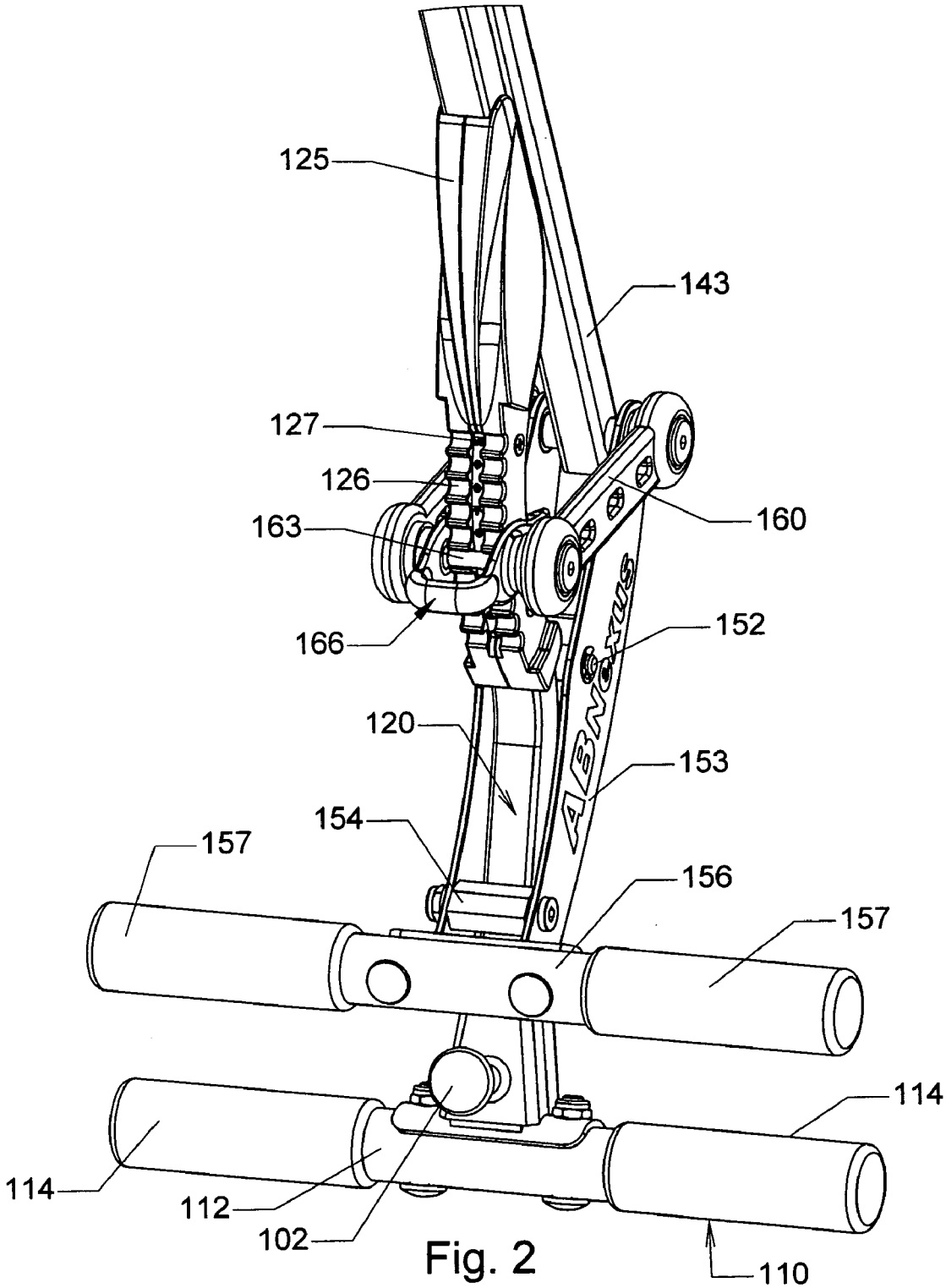
FIG. 2 is an enlarged perspective view of a lower portion of the exercise device of FIG. 1.
Figure 3:
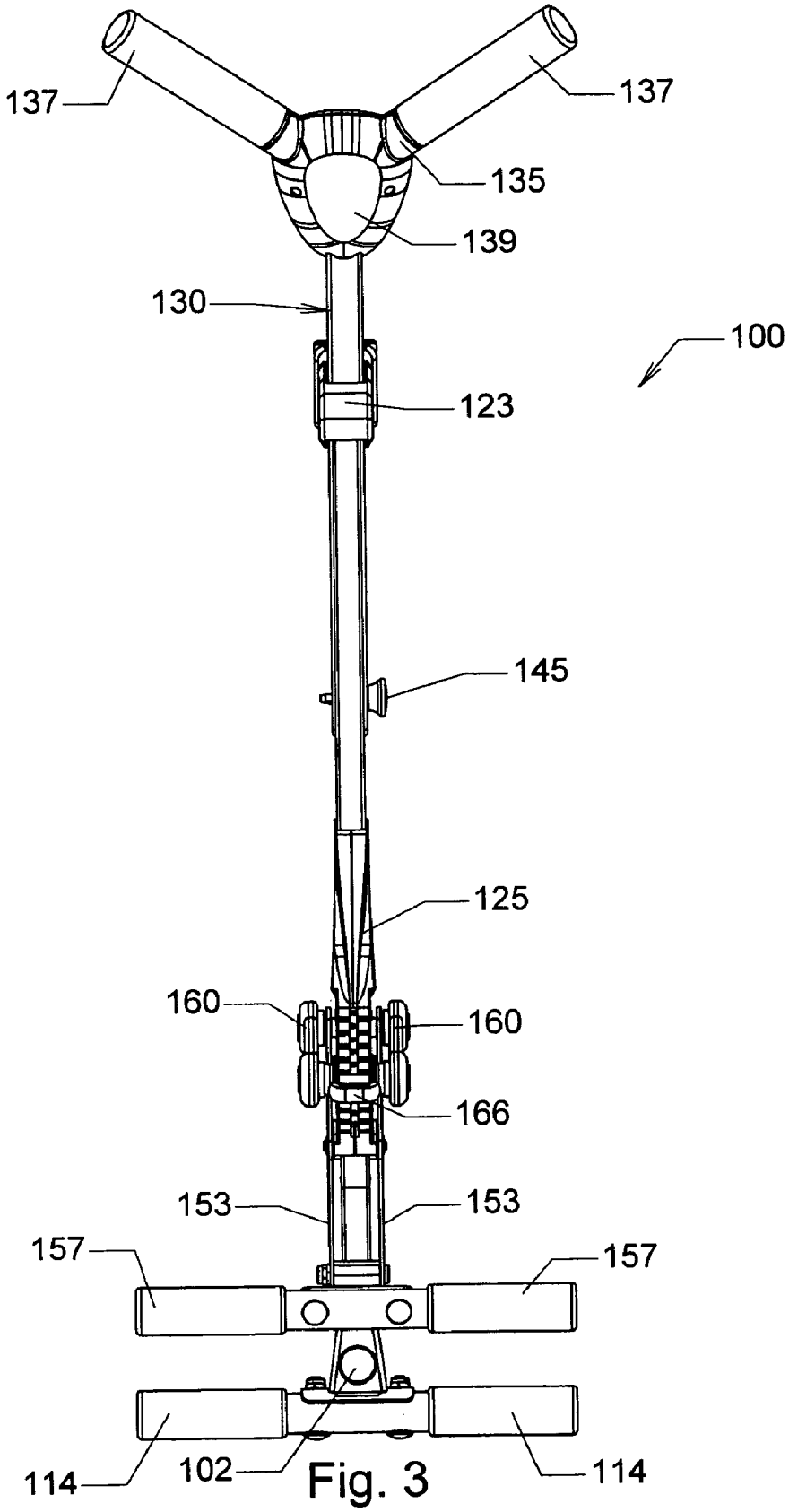
FIG. 3 is a rear view of the exercise device of FIG. 1.
Figure 4:
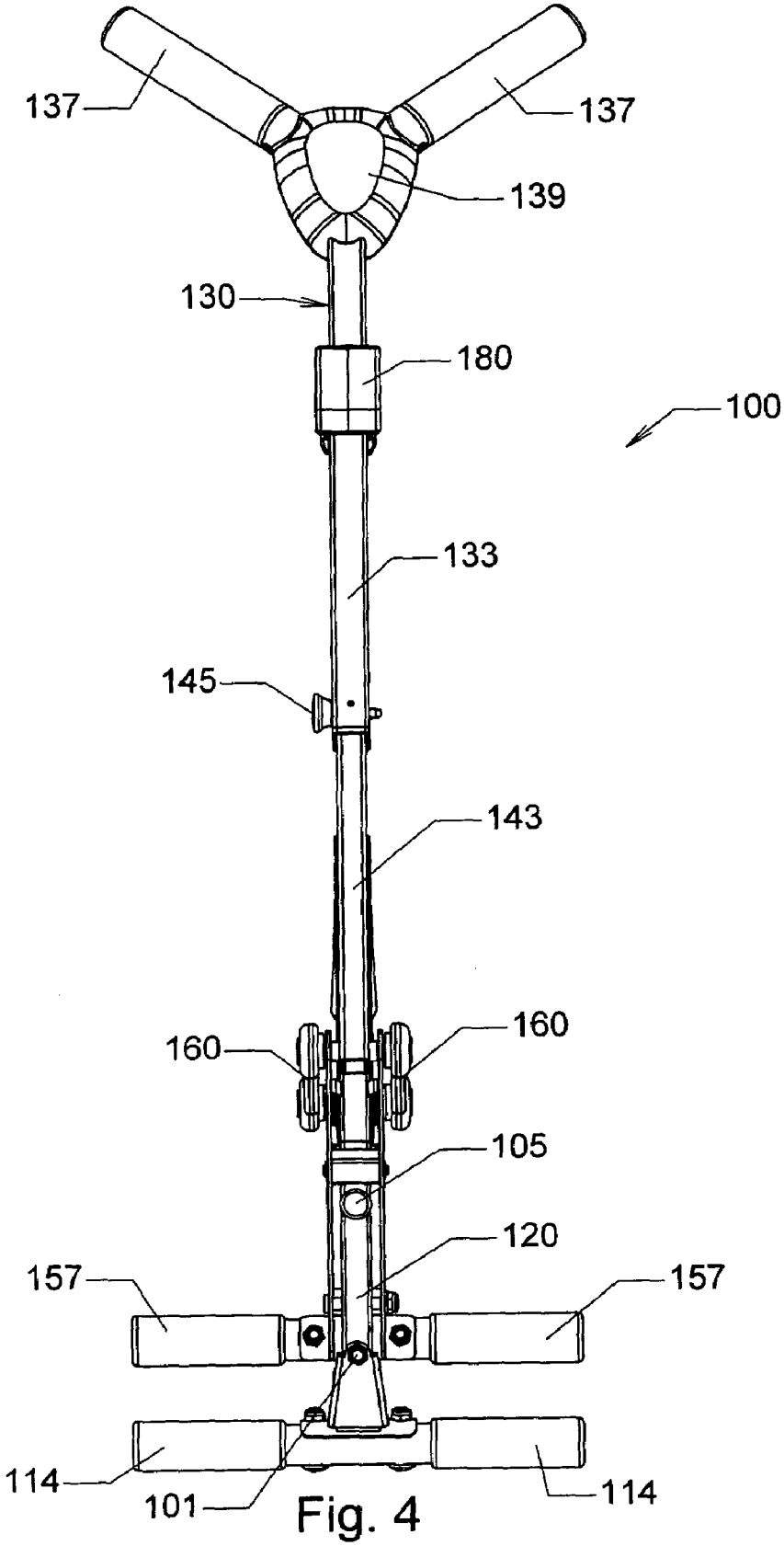
FIG. 4 is a front view of the exercise device of FIG. 1.
Figure 5:
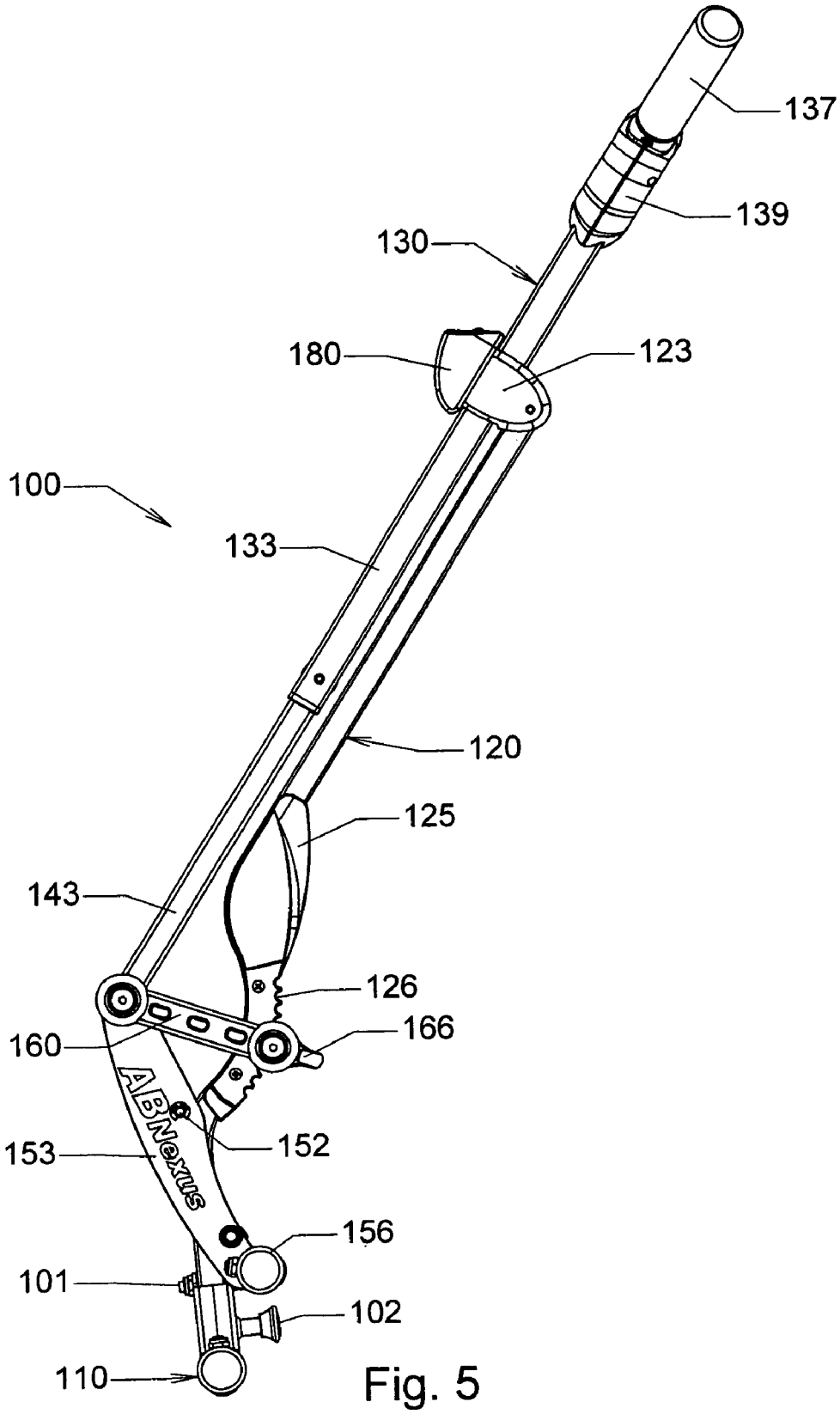
FIG. 5 is a side view of the exercise device of FIG. 1.
Figure 6:
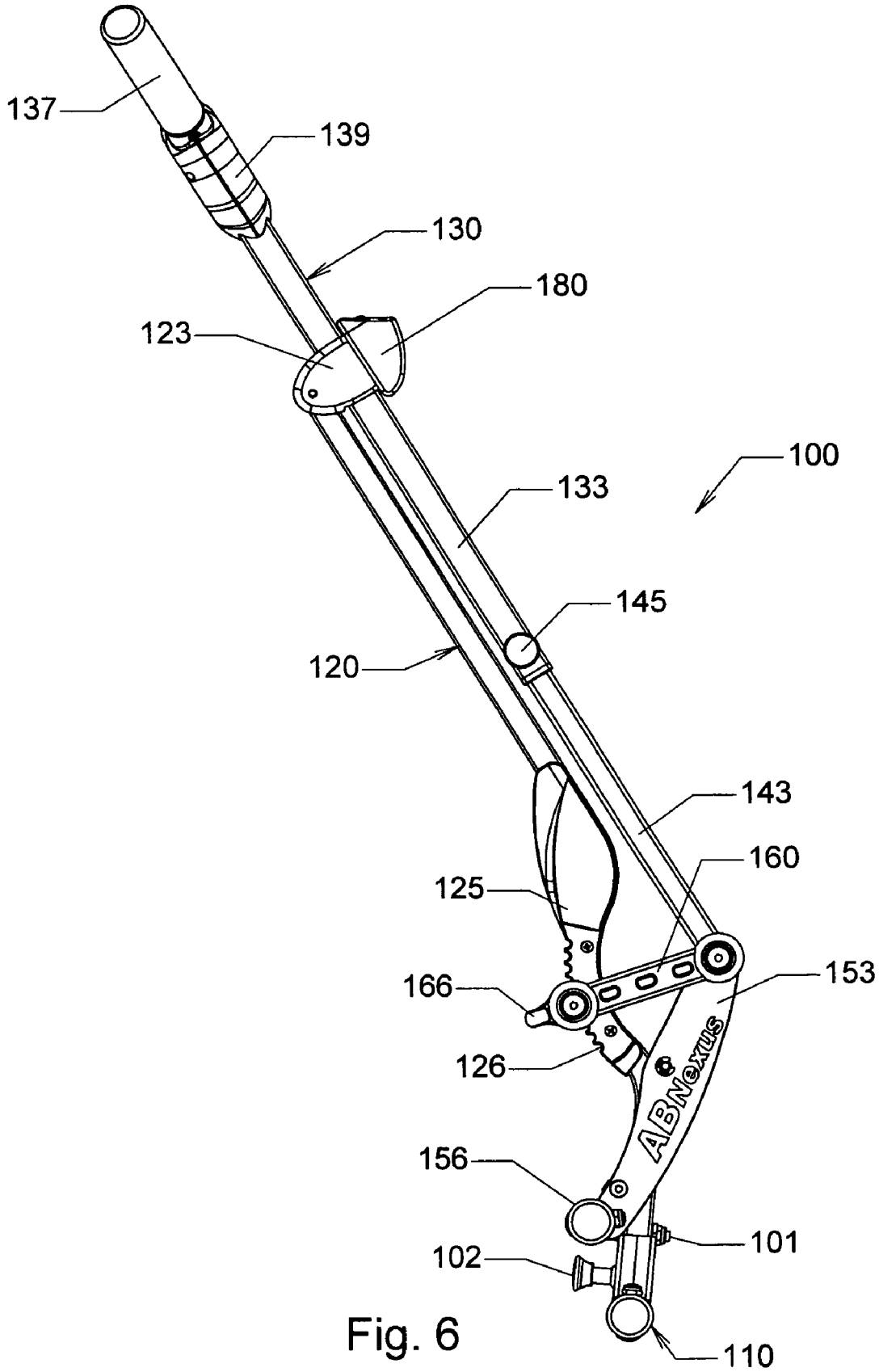
FIG. 6 is an opposite side view of the exercise device of FIG. 1.
Figure 7:
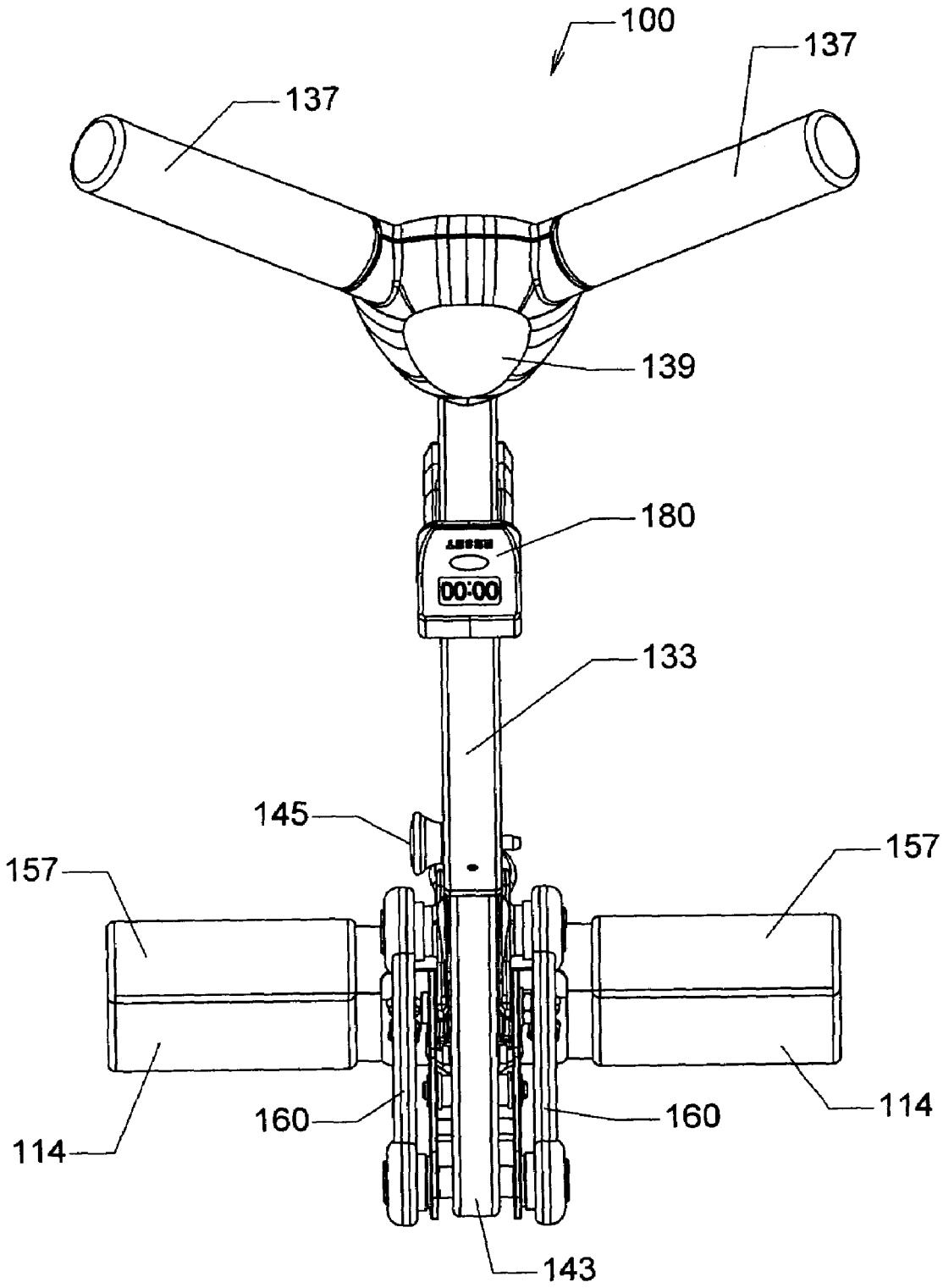
FIG. 7 is a top view of the exercise device of FIG. 1.
Figure 8:
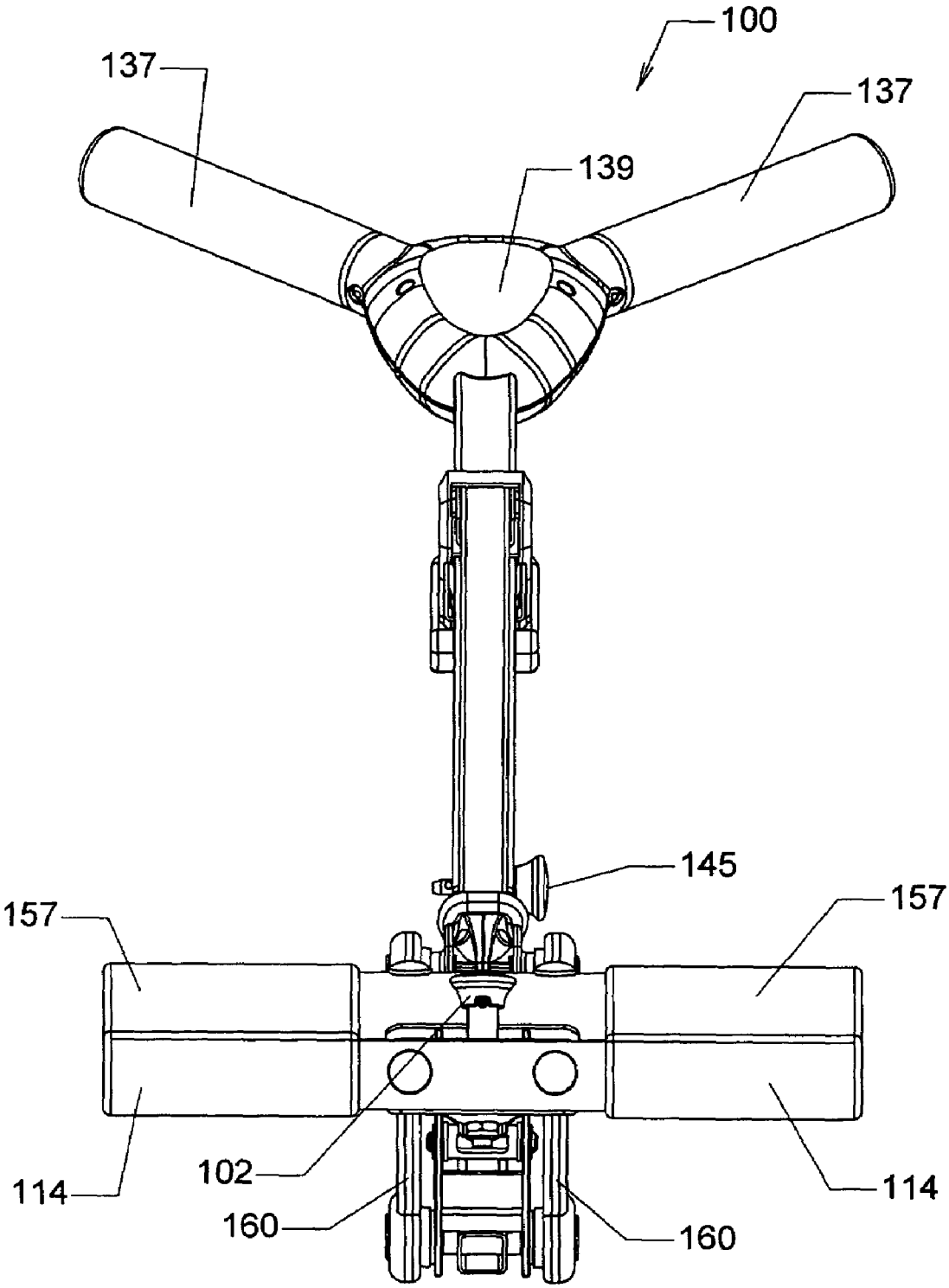
FIG. 8 is a bottom view of the exercise device of FIG. 1.

As shown in somewhat greater detail in FIG. 2, the resistance system includes first and second elastic bands or resilient members 160 that are interconnected between the stanchion 120 and the body supports 130 and 150. In this regard, each elastic band 160 has a forward end that terminates in a collar, and these collars are secured to respective sides of the pivot joint defined between the lower bar segment 143 and the bars 153. Among other things, those skilled in the art will recognize that the elastic bands 160 may be replaced by other suitable means, and/or connected to only one of the body supports 130 and 150 (since the body supports 130 and 150 are linked to one another).

Each elastic band 160 has an opposite, rearward end that also terminates in a collar, and these collars are secured to opposite ends of a bar or pin 163 that is configured to occupy any of several grooves or slots 126 in a member 125 on the stanchion 120. The grooves 126 are interrupted by a centrally located, longitudinally extending flat surface that bears indicia 127 to designate various available resistance settings (e.g. 1 to 10) associated with respective grooves 126. A U-shaped handle 166 is secured to opposite ends of the pin 163 to facilitate user movement of the pin 163 (to adjust the resistance setting). Tension in the elastic bands 160 biases the pin 163 to remain seated or engaged in a desired groove 126 in the absence of user applied force on the handle 166. Also, the grooves 126 are preferably arranged in an arc that is centered about the pivot axis associated with the forward ends of the elastic bands 160, so that the amount of "at rest" tension in the bands 160 is similar at each resistance setting.

The different resistance settings cause the bands 160 to experience different amounts of strain in response to a given amount of exercise motion. In this regard, the lowermost groove 126 positions the pin 163 closest to the pivot joint 152 and defines the lowest resistance setting, and the uppermost groove 126 positions the pin 163 farthest from the pivot joint 152 and defines the highest resistance setting.

The present invention facilitates exercise of a person's upper abdominal muscles (by user force exerted downward against the hand grips 137 and/or the chest pad 139), and exercise of a person's lower abdominal muscles (by user force exerted upward to lift the user's legs). Moreover, the present invention facilitates exercise of a person's oblique muscles (by performing the foregoing exercises while tilting the stanchion 120 relative to the base 110, and/or by user exerted force that rocks and/or twists the hand grips relative to the telescoping bar, as described but not shown).

A user interface 180 may be mounted on the device 100 to perform various functions in connection with one or more of the foregoing exercises. For example, together with a sensor, the interface 180 may indicate the number of crunch exercises performed, the total time spent exercising, and/or the length and/or duration of each exercise stroke.

As shown in FIG. 10, a person P may use the device 100 by sitting on a conventional chair 90 with the device 100 between her knees, and stabilizing the device 100 relative to the chair 90 and/or the ground 99 beneath the chair 90. In the case of the preferred embodiment 100, the base 110 of the device 100 is placed on the ground 99 in front of the chair 90. An alternative embodiment may be configured for mounting on or against the chair 90 as an alternative to the floor 99. In either case, the person P places her feet F on respective sides of the foot rest 156, and grasps the hand grips 137 in her respective hands H and/or presses her chest against the chest pad 139. The person P then presses down with her hands H and/or her chest, and/or lifts up with her feet F, subject to resistance provided by the elastic bands 160 (as well as gravity acting on the person's legs). As noted above, the person P may adjust the resistance as desired.

The present invention has been described with reference to a preferred embodiment and a particular application. However, this disclosure will enable persons skilled in the art to recognize additional embodiments and/or applications which similarly incorporate the essence of the present invention. With the foregoing in mind, the scope of the present invention is to be limited only to the extent of the following claims.

What is claimed is:

1. A method of exercise in combination with a conventional chair, comprising the steps of:

providing an abdominal exercise device with (a) a frame having a lower end configured to bear against a floor surface; (b) an upper body support movably mounted on the frame; and (c) a foot rest movably mounted on the frame; and encouraging a person to (a) sit on a conventional chair; (b) support the abdominal exercise device in an operational position in front of the chair; (c) place her feet on the foot rest; (d) grasp the upper body support; and (e)

perform an abdominal crunch exercise, wherein her chest moves downward together with the upper body support, and her legs move upward together with the foot rest.

2. The method of claim 1, wherein the abdominal exercise device is provided with a resistance device having a first end connected to the frame, and an opposite, second end connected to at least one of the upper body support and the foot rest, and further comprising the step of encouraging the person to adjust the resistance device prior to performing the abdominal crunch exercise.

3. The method of claim 2, wherein the adjustment step is performed by relocating the first end of the resistance device relative to the frame.

4. The method of claim 3, wherein the adjustment step involves rotating the resistance device about the second end.

5. The method of claim 4, wherein the adjustment step involves relocating the first end of the resistance device along an arc that is centered about the second end.

6. The method of claim 1, wherein the foot rest is pivotally mounted on the frame, and the upper body support is slidably connected to a sleeve that is pivotally mounted on the frame, and the upper body support is pivotally connected to the foot rest, and the abdominal crunch exercise is performed by forcing the upper body support to slide downward through the sleeve.

7. The method of claim 1, wherein the frame includes a base and a stanchion that is pivotally connected to the base, and both the upper body support and the foot rest are movably mounted on the stanchion, and the person is encouraged to pivot the stanchion relative to the base in connection with performance of the abdominal crunch exercise.

8. The method of claim 1, wherein the lower body support is linked to the upper body support in a manner that constrains the foot rest and the upper body support to move in opposite directions, and performance of the abdominal crunch exercise involves contemporaneous movement of the person's chest and legs toward one another.

9. The method of claim 8, wherein the abdominal exercise device is provided with a resistance device having a first end connected to the frame, and an opposite, second end connected to at least one of the upper body support and the foot rest, and further comprising the step of encouraging the person to adjust the resistance device prior to performing the abdominal crunch exercise.

10. The method of claim 9, wherein the adjustment step is performed by relocating the first end of the resistance device relative to the frame.

11. The method of claim 10, wherein the adjustment step involves rotating the resistance device about the second end.

12. The method of claim 11, wherein the adjustment step involves relocating the first end of the resistance device along an arc that is centered about the second end.

13. The method of claim 8, wherein the foot rest is pivotally mounted on the frame, and the upper body support is slidably connected to a sleeve that is pivotally mounted on the frame, and the upper body support is pivotally connected to the foot rest, and the abdominal crunch exercise is performed by forcing the upper body support to slide downward through the sleeve.

14. The method of claim 8, wherein the frame includes a base and a stanchion that is pivotally connected to the base, and both the upper body support and the foot rest are movably mounted on the stanchion, and the person is encouraged to pivot the stanchion relative to the base in connection with performance of the abdominal crunch exercise.

15. A portable exercise apparatus designed for use by a person seated on a conventional chair, comprising:

a frame having a lower end configured to rest on a floor surface in front of the chair;

an upper body support movably mounted on the frame, and configured and arranged to be grasped by the person seated on the chair when the lower end is resting on the floor surface in front of the chair;

a foot rest movably mounted on the frame, and configured and arranged to support the feet of the person seated on the chair when the lower end is resting on the floor surface in front of the chair; and a linkage interconnected between the upper body support and the foot rest in a manner that constrains the foot rest to move upward in response to downward movement of the upper body support, thereby facilitating an abdominal crunch exercise that involves the person's upper and lower abdominal muscles.

* * * * *